US006166390A

United States Patent [19]

Quapp et al.

[11] Patent Number: 6,166,390

[45] Date of Patent: Dec. 26, 2000

[54] RADIATION SHIELDING COMPOSITION

[75] Inventors: William J. Quapp; Paul A. Lessing, both of Idaho Falls, Id.

[73] Assignee: Bechtel BWXT Idaho, LLC, Idaho Falls, Id.

[21] Appl. No.: 09/123,979

[22] Filed: Jul. 28, 1998

Related U.S. Application Data

[63] Continuation-in-part of application No. 08/378,161, Jan. 23, 1995, Pat. No. 5,786,611.

[51] Int. Cl.[7] ..... G21F 3/00

[52] U.S. Cl. ..... 250/506.1; 250/515.1; 250/518.1

[58] Field of Search ..... 250/506.1, 515.1, 250/517.1, 518.1; 588/3, 4; 252/478; 376/272

[56] References Cited

U.S. PATENT DOCUMENTS 5,015,863 5/1991 Takeshima et al. ..... 250/506.1
5,786,611 7/1998 Quapp et al. ..... 250/515.1
5,832,392 11/1998 Forsberg ..... 250/506.1
5,949,084 9/1999 Schwartz ..... 250/506.1

*Primary Examiner*—Kiet T. Nguyen
*Attorney, Agent, or Firm*—Thorpe North & Western

[57] ABSTRACT

A composition for use as a radiation shield. The shield is a concrete product containing a stable uranium aggregate for attenuating gamma rays and a neutron absorbing component, the uranium aggregate and neutron absorbing component being present in the concrete product in sufficient amounts to provide a concrete having a density between about 4 and about 15 grams/cm$^3$ and which will at a predetermined thickness, attenuate gamma rays and absorb neutrons from a radioactive material of projected gamma ray and neutron emissions over a determined time period. The composition is preferably in the form of a container for storing radioactive materials that emit gamma rays and neutrons. The concrete container preferably comprises a metal liner and/or a metal outer shell. The resulting radiation shielding container has the potential of being structurally sound, stable over a long period of time, and, if desired, readily mobile.

30 Claims, 3 Drawing Sheets

RADIATION SHIELDING COMPOSITION

RELATED APPLICATION

This is a continuation-in-part of U.S. application Ser. No. 08/378,161 filed Jan. 23, 1995, now U.S. Pat. No. 5,786,611, which is incorporated herein by reference.

CONTRACTUAL ORIGIN OF THE INVENTION

The United States Government has rights in this invention pursuant to Contract No. DE-AC07-761D01570 between the U.S. Department of Energy and EG&G Idaho, Inc., now Contract No. DE-AC07-94ID13223 between the U.S. Department of Energy and Lockheed Idaho Technologies Company.

BACKGROUND OF THE INVENTION

1. Field of the Invention

This invention relates to radiation shielding for radioactive materials. More particularly, this invention relates to a shielding composition and container for attenuating gamma rays and absorbing neutrons.

2. Description of the Prior Art

Much effort has gone into developing economical ways to store and finally dispose of increasing amounts of radioactive wastes generated from nuclear power plants and other nuclear facilities, as well as heavy metal sludges from chemical plants. A significant portion of this effort has been directed at improved radiation shielding compositions and containers.

High-level radioactive wastes, including liquids from reprocessing and spent (used) nuclear fuel, typically have half-lives of hundreds of thousands of years. The reprocessing material is generally stored as liquids, then solidified, permanently stored, and disposed of as required. Spent nuclear fuel is stored initially in water cooled pools at the reactor sites awaiting shipment to a permanent disposal site. After about ten years, the fuel can be moved to dry storage containers until such time that the permanent disposal facility becomes available.

Ideal containers for storage and transport of radioactive wastes should confine them safely for at least about 100 years, and preferably about 300 years.

Lead has often been used for gama ray shielding because it is dense, easily worked and relatively inexpensive. Additionally, a lead shield can often be thinner and more compact than a comparable radiation shield made of almost any other material except depleted uranium. This ability to take up less space and be more portable is highly desirable for radiation shielding systems since it is often necessary to move the shielding systems, such as to more remote locations for safety purposes. Additionally, it is often necessary to move the shielding systems, such as to more remote locations for safety purposes. Additionally, it is often desirable to build shielding systems in locations where there is limited space. Since lead tends to accumulate in the body, similar to other heavy-metal poisons, and continues producing toxic effects for many years after exposure it is desirable to eliminate lead from many of its present uses, including radiation shielding, and define substitutes for lead. Efforts have been made to develop radiation shielding systems utilizing depleted uranium (chiefly uranium-238). For example, Takeshima et al., in U.S. Pat. No. 4,868,400, discloses the use of depleted uranium rods or small balls as radiation shielding in an iron cask for shipping and storing spent nuclear fuel.

Due to the radioactivity of uranium, its tendency to corrode and other factors, uranium is usually accompanied by an over coating of anon-radioactive, highly absorbent material, such as steel. For example, in U.S. Pat. No. Re. 29,876, Reese discloses a depleted uranium container, with a corrosion-free coating of stainless steel for transporting radioactive materials. U.S. Pat. No. 5,015,863, Takeshima et al., teaches using depleted uranium particles coated with a metal of high thermal conductivity, such as, aluminum, copper, silver, magnesium, or the like.

Alternative shielding system taught in U.S. Pat. No. 5,334,847, Kronberg teaches a radiation shield having a depleted uranium core for absorbing gamma rays with a bismuth coating for preventing corrosion, and alternatively having a gadolinium sheet positioned between the uranium core and the bismuth coating for absorbing neutrons.

These uranium metal based shielding systems, however, suffer the problem of being relatively expensive. But an even greater difficulty is the avoidance of uranium corrosion and the assurance of the desired long life of the shielding system for spent nuclear fuel. Commercial shielding systems based upon the use of concrete as the shielding material have been developed due to the relatively low cost of concrete relative to metals such as steel, lead and depleted uranium, as well as the ease of casting the material into the desired form in order to assure structural stability it has been necessary to build composite systems such as ones containing a metal liner with a thick concrete outer shell for shielding of the gamma and neutron radiation. Due to these advantages concrete shielding systems now completely dominate the market for shielding of radioactive materials.

However, these concrete systems generally lack mobility or limit the volume of radioactive material that can be stored in a given space due to the great concrete thickness required to obtain the necessary shielding properties. Yoshihisa, in Japanese Patent Document No. 61-091598, does teach the utilization of depleted uranium and uranium oxide aggregate containing concrete for radiation shielding. While this system does have the potential for reducing the thickness of the radiation shielding while maintaining the desired gamma ray penetration factor there are serious problems with this system with degradation of the concrete and obtaining the desired system life of one hundred years, particularly at elevated temperatures. Mechanical properties of the concrete, such as tensile strength and compressive strength, are seriously degraded at elevated temperatures by addition of the uranium aggregate to the concrete.

An attempt at reducing the thickness of a concrete shield while maintaining the desired long life of the container is taught by Suzuki et al., in U.S. Pat. No. 4,687,614. This reference teaches a three layered structure comprising a metallic vessel with a concrete lining as an inner layer which is reinforced with a reinforcing material and strengthened with a polymeric impregnant, and a polymerized and cured impregnant layer as an intermediate layer between the metallic and concrete layers. However, this and like attempts have generally been unsuccessful in achieving the desired size reduction, while maintaining the cost advantages and desired strength and other properties of conventional concrete systems.

SUMMARY OF THE INVENTION

A general, object of this invention is to provide a radiation shielding composition comprising a concrete product containing a stable uranium aggregate for absorbing gamma rays and a neutron absorbing component that is suitable as a container for use in storage and disposal of radioactive waste or industrial wastes, as well as a process for fabricating such a container. The uranium compound of the aggregate is preferably a uranium compound depleted in the uranium 235 fissile isotope. A more specific object of this invention is to provide a radiation shielding composition suitable for use in a container and a process for fabricating the same; the composition comprising a concrete product containing a stable uranium aggregate for absorbing gamma rays and a neutron absorbing component, the uranium aggregate and neutron absorbing component being present in the concrete product in sufficient amounts to provide a concrete having a density between about 4 and about 15 grams per cubic centimeter and which will, at a predetermined thickness, attenuate gamma rays and absorb neutrons from a radioactive material of projected gamma ray and neutron emissions over a determined time period. A preferred embodiment is a container for storing radioactive materials that emit radiation such as gamma rays and neutrons and comprising the concrete composition of this invention in the form of a container having a metal liner and/or an exterior metal shell or coating.

Another object of this invention is to provide a concrete shielding material suitable for use in radiation shielding containers which are economical, having a potential for reduced thickness of the radiation shielding while maintaining the desired gamma ray attenuation factor and neutron absorption factor, and while avoiding problems with degradation with the concrete and obtaining the desired system life of at least one hundred years, and preferably three hundred years, particularly at elevated temperatures.

Still another object of this invention is to provide a shielding container comprising gamma ray attenuating components and neutron absorbing components in a predetermined ratio, and wherein the thickness of the walls of the container are predetermined to allow minimum thickness of the walls with respect to the radioactive material being contained.

Yet a further object of this invention is to address the serious world problem of disposal and storage of depleted uranium by developing a viable commercial application for depleted uranium for radiation shielding purposes.

These and other objects, as well as the advantage of the present invention will be apparent by reading the following description taken in conjunction with the accompanying drawings.

DETAILED DESCRIPTION OF THE PREFERRED EMBODIMENTS

Figure 1:
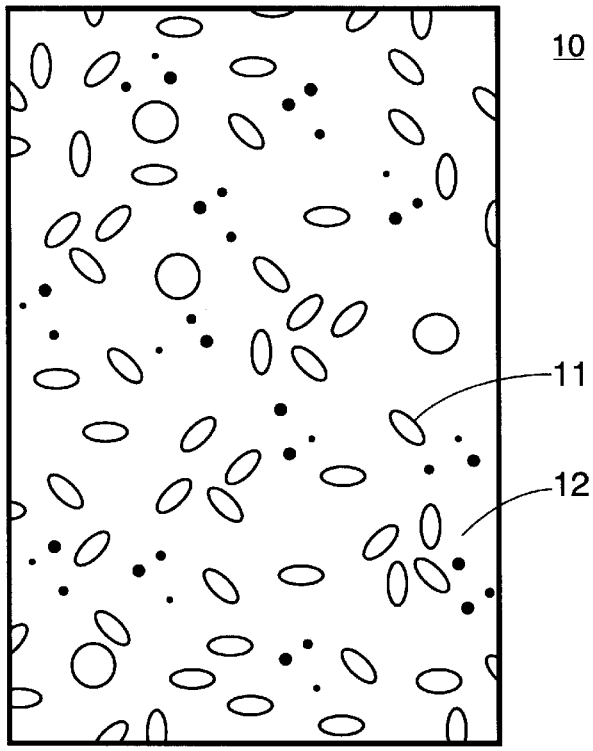
FIG. 1 is a side cross sectional view of the concrete shielding composition of this invention comprising stable depleted uranium aggregates.

This invention relates to a radiation shielding concrete composition comprising a stable, depleted uranium aggregate, a radiation shielding container utilizing this composition, and a process for fabrication of the same. A container of this invention is suitable for use in storage and disposal of radioactive wastes emitting gamma rays and neutrons.

This invention relates to concrete radiation shielding composition and container made therefrom having a long-term durability, good handling properties and maximum internal capacity, capability of good structural stability and minimal thickness of the concrete shielding materials for the particular radioactive materials being stored.

An especially desirable feature of this invention is the ability to utilize depleted uranium for a useful purpose, thus solving a serious waste disposal problem that exists around the world for depleted uranium due to its radioactivity. Depleted uranium is in the form of uranium hexafluoride which is very reactive and readily forms a gas near room temperature. Past efforts to utilize depleted uranium, the form of uranium was such that it was either very expensive to form the shielding container and/or it was in a very chemically reactive form which was difficult, if not impossible, to obtain the desired long-life of the shielding container. The depleted uranium compound aggregate of this invention has the potential to be formulated relatively inexpensively for use in forming concrete containers with the desired long-life stability even at elevated temperatures.

The depleted uranium used in the aggregate of this invention may be:

(a) a compound which is inherently stable and nonreactive with the concrete, such as a uranium silicide, (b) a more reactive form, such as uranium or a uranium oxide compound, which is coated with a protective coating to prevent reaction between the uranium compound and the concrete, air, and moisture, even at the elevated temperatures, or (c) a stable ceramic form of uranium, e.g., formed by sintering.

The term "stable" as applied to the uranium compound aggregate or the neutron acceptor aggregate according to this invention refers to chemical stability and is defined as that ability of such aggregate or additive to avoid the degradation of the concrete composition containing such aggregate or additive when such composition is maintained at a temperature of 90° C., and more preferably at 250° C., for a period of at least one month in an environment which would be saturated with water vapor at room temperature.

The term "neutron absorbing component" as used herein means a component or material which interacts with neutrons omitted from the radioactive material being shielded to produce the shielding effect desired in this invention. This term thus includes those components which attenuate and/or absorb neutrons.

The concrete shielding composition of this invention preferably contains reinforcing materials, such as steel bars, necessary to meet structural requirements for accidents and seismic events, reinforcing fillers and/or strengthening impregnants. These materials include steel fiber, glass fiber, polymer fiber, lath and reinforcing steel mesh. A preferred embodiment of the concrete shielding container of the invention additionally includes means for cooling the surface or surfaces of the concrete during storage to further promote length of life of the concrete container by avoiding high temperatures. Most of the gamma radiation will be attenuated by the uranium oxide and other materials of construction (steel, cement, etc.). The stable uranium aggregate of this invention will be added to the concrete as a replacement for the conventional gravel. The physical form of the uranium aggregate will preferably be as a sintered uranium containing material.

Uranium compounds which are useful in the aggregates of this invention include uranium oxides such as $UO_2$ $U_3O_8$, and $UO_3$; uranium silicides such as $U_3Si$ and $U_3Si_2$; $UB_2$; and UN.

In order to obtain the stable depleted uranium compound aggregates according to this invention it is generally required to form aggregates with a coating which will be water and/or air impermeable. Coating materials suitable for this invention for the uranium aggregate or the neutron absorbing additive are the following: glasses such as those which are well known in the ceramic arts made from silicon dioxide, clays and other like materials; and polymers such as polyethylene, epoxy resin, polyvinyl chloride, polymethylmethacrylate, and polyacrylonitrile. Care must be taken to avoid those coatings which will be readily destroyed by corrosion, chemical reaction or degradation by the surrounding environment. For this reason the ceramic glass coatings are especially preferred.

An additional form of coating suitable for the uranium aggregate or the neutron absorbing additive of this invention may be the reaction of the surface of the aggregate or additive to stabilize it to reaction with air, water and the like. Uranium metal aggregates can, for example, be reacted with silicon to form a stable surface of uranium silicide.

The concrete product containing the uranium aggregates of this invention may range in density from about 4 to about 15 grams per $cm^3$. However, due to the extreme chemical reactivity and expense of the more dense uranium metal the uranium compounds described herein are much preferred. Therefore, a preferred density range for the concrete product is between about 5 and about 11 grams per $cm^3$.

The uranium aggregates of this invention generally have a particle size between about ⅛ inch and about 4 inches in diameter, preferably between about ¼ inch and about 1½ inches in diameter, and more preferably between about ½ inch and about ¾ inch in diameter in order to best achieve the balance of desired properties of the concrete and the stability described herein.

When high loadings of the uranium aggregate of this invention are attempted in a concrete mix a problem arises in obtaining the desired uniform distribution of the uranium aggregate throughout the concrete. In order to solve this problem it has been found desirable to first add the uranium aggregate to a mold and then add the liquid cement around the aggregate to fill up the mold. Even more preferred is to add the liquid cement from the bottom of the mold to avoid bubbling of the air or other gas that may be rapped in the mold, which bubbling can cause voids in the final solid concrete wall.

The concrete walls of the radiation shield of this invention can be significantly reduced in thickness resulting in the aforementioned advantages of this invention. While wall thickness will vary depending upon the amount of gamma rays and neutrons being emitted from the particular radioactive material being shielded the wall thickness of the radiation shield of this invention will range between about 2 and about 20 inches and more commonly between about 8 and about 12 inches.

In preparing the various shielding compositions of this invention it crucial to preserve certain properties of the concrete to properly function as a storage container and to be able to withstand the stress of moving the concrete container filled with nuclear material for example, without suffering breakage.

Compressive strength should generally range between about 500 and about 12,000 psi and more commonly between about 3000 and about 5000 psi. The tensile strength of the concrete shield should be between about 50 and about 1200 psi and preferably between about 300 and about 500 psi.

An especially preferred uranium aggregate according to this invention due to its hardness, strength, stability, resistance to leaching and low cost is a finely divided sintered uranium material, preferably a uranium oxide or a mixture of uranium oxide which has been fused, preferably by a liquid phase sintering technique. The stable uranium aggregate according to this embodiment comprises a sintered mixture of a finely divided uranium material and one or more phases derived from a reactive liquid.

The finely divided uranium material generally has a particle size between about ½ and about 100 microns in diameter and preferably between about 1 and about 30 microns in diameter in order to achieve the desired properties described herein.

The preferred liquid phase sintering process for uranium dioxide powder according to this invention is carried out at a temperature between about 1000° C. and about 1500° C. in an oxidizing atmosphere (e.g., air or oxygen) or in a reducing atmosphere (e.g., nitrogen, argon, vacuum or hydrogen), compared to normal solid state sintering of uranium dioxide powder of about 1700° C. in a vacuum or a reducing atmosphere. Costs are reduced in the liquid phase sintering process because a less complex and thus less expensive sintering furnace can be utilized. Also costs can be reduced because inexpensive materials such as soil and/or clay can be used as starting materials to form the reactive liquid phase by application of sufficient heat. Additionally the starting materials can contain many impurities, unlike sintered nuclear reactor fuel which has to be of high purity to prevent neutron absorption by the various impurities that poison the fission process.

Clay as a starting material in the liquid phase sintering process is especially preferred because it provides plasticity and binding properties to the mixture containing finely divided uranium material and thus greatly aids the "green" forming of the mixture prior to firing application of heat in the furnace liquid phase sintering). Solid state sintering processes by contrast require expensive organic binders be added to the finely divided uranium materials in order to provide sufficient plasticity for green forming (e.g., dry pressing or extrusion) and to increase the green density and provide sufficient strength for handling the mixture during green forming and handling prior to application of heat.

Additionally the liquid phase sintering process allows addition of neutron absorbing additives in order to form a composite sintered aggregate containing both a stable uranium material for attenuating gamma rays and a stable neutron absorbing material.

The finely divided uranium material, e.g., uranium oxide, is contained in the liquid phase sintered aggregate in one or more of the following three physical forms: (1) chemically bound in an amorphous or glass phase, (2) chemically bound in crystalline mineral phases, e.g., uranophane, zirconolite, and coffinite, and (3) one of the oxide phases physically surrounded by crystalline and amorphous phases. These phases are stable and resist reaction with substances such as water, steam, oxygen, chemical phases in Portland cement (e.g., $Ca(OH)^2$) and weak acids and bases.

Preferred mineral precursors useful in the preferred liquid phase sintering process of this invention are natural or synthetic basalt. Preferably the basalt is finely ground prior to heating to form the reactive liquid phase. Preferably the finely ground basalt has an average particle size of between about 1 and 50 microns and more preferably between about 5 and about 20 microns. Especially preferred basalt materials are ones comprising (a) silicon oxide (e.g., $SiO_2$) in an amount between about 25 and about 60 weight percent, aluminum oxide (e.g., $Al_2O_3$) in an amount between about 3 and about 20 weight percent, (c) iron oxide (e.g., $Fe_2O_3$ and/or FeO) in an amount between about 10 and about 30 weight percent, titanium oxide (e.g., $TiO_2$) in an amount between 0 and about 30 weight percent; (e) zirconium oxide (e.g., $ZrO_2$) in an amount between 0 and about 15 weight percent, (f) calcium oxide (e.g., CaO) in an amount between 0 and 15 weight percent, (g) magnesium oxide (e.g., MgO) in an amount between 0 and about 5 percent, (h) sodium oxide (e.g., $Na_2O$) in an amount between 0 and about 5 weight percent, and (i) potassium oxide (e.g., $K_2O$) in an amount between about 0 and about 5 weight percent, and wherein the weight percents are based on the total weight of the basalt composition prior to addition of the uranium material.

The sintering process for producing the uranium aggregate of this invention may additionally require application of external pressure. The application of pressure in the sintering process has the advantage of eliminating the need for very fine particle materials, and also removes large pores caused by nonuniform mixing.

The neutron absorbing components of the shielding compositions and container of this invention include compounds containing hydrogen and/or oxygen, and/or additives such as compounds of boron, hafnium and gadolinium. Examples of such additive compounds are boron carbide, boron frits, boron containing glass, $B_2O_3$, $HfO_2$ and $Gd_2O_3$. In general, most of the neutron radiation absorption will be provided by the hydrogen contained in the waterassociated with the cement.

The neutron absorbing additives may be added in amounts to meet the shielding needs of the radioactive material being shielded without significantly destroying the desired strength and other properties of the concrete. However, when boron is used as an additive it will normally be added in an amount between 0 and about 5% by weight of the total weight of the concrete, and preferably between about 0 and about 2% by weight. Gadolinium or hafnium will generally be added in an amount between about and about 50% by weight of the total weight of the concrete shield and more commonly between about 15 and about 20% by weight.

With reference to the figures, and in particular FIGS. 1–5, the concrete product of this invention is shown. As shown in FIG. 1, the concrete product 10 contains stable uranium aggregate 11 dispersed in concrete 12, preferably made of Portland cement and containing hydrogen atoms as part of compounds which make up the concrete which hydrogen atoms act as neutron absorbing components of the concrete product.

Figure 2:
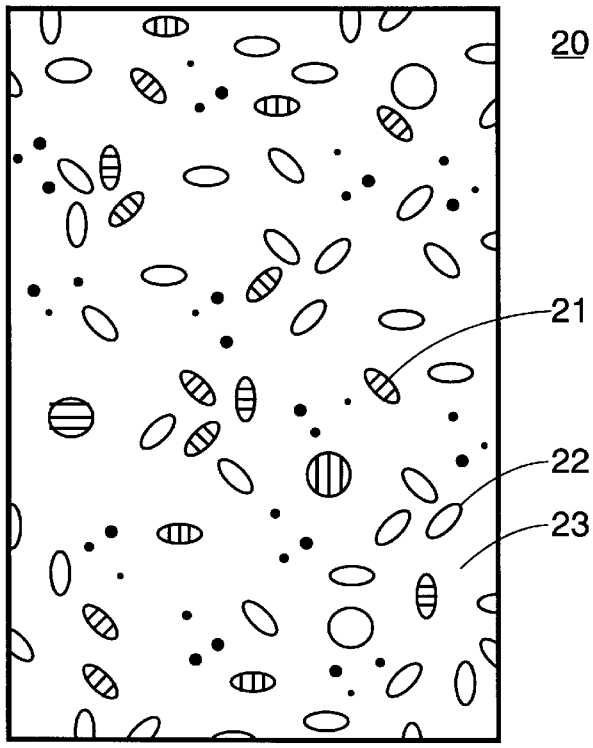
FIG. 2 is a side cross sectional view of the concrete shielding composition of this invention comprising stable depleted sintered uranium aggregates and stable coated neutron absorbing additives.

As shown in FIG. 2 the concrete product 20 contains stable neutron absorbing additives 21 such as boron as well as stable uranium aggregate 22 dispersed in concrete 23.

Figure 3:
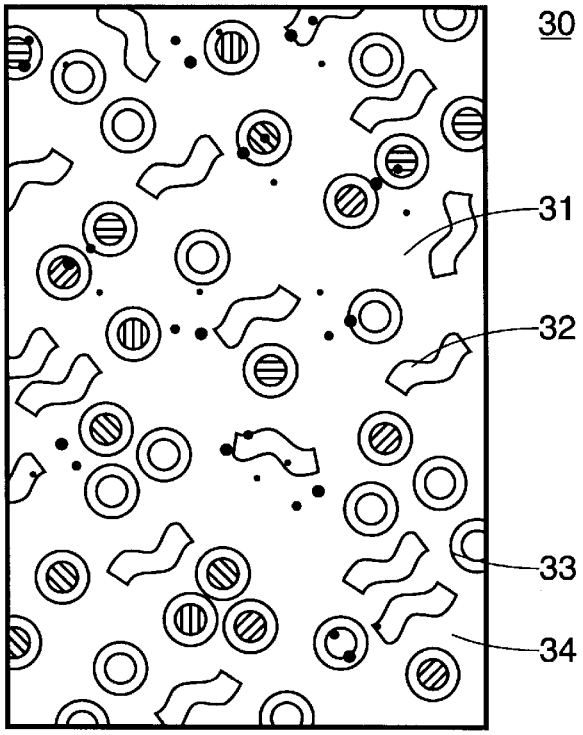
FIG. 3 is a side cross sectional view of a radiation shielding concrete composition comprising a stable depleted coated uranium aggregate for attenuating gamma radiation and a stable coated neutron absorbing additive and metal rebar and strengthening fibers and/or fillers.

As shown in FIG. 3 concrete product 30 contains a stable coated uranium aggregate 31, a coated stable neutron absorbing additive 32, and reinforcing materials 33 such as rebar, fibers, and fillers dispersed in concrete 34.

Figure 4:
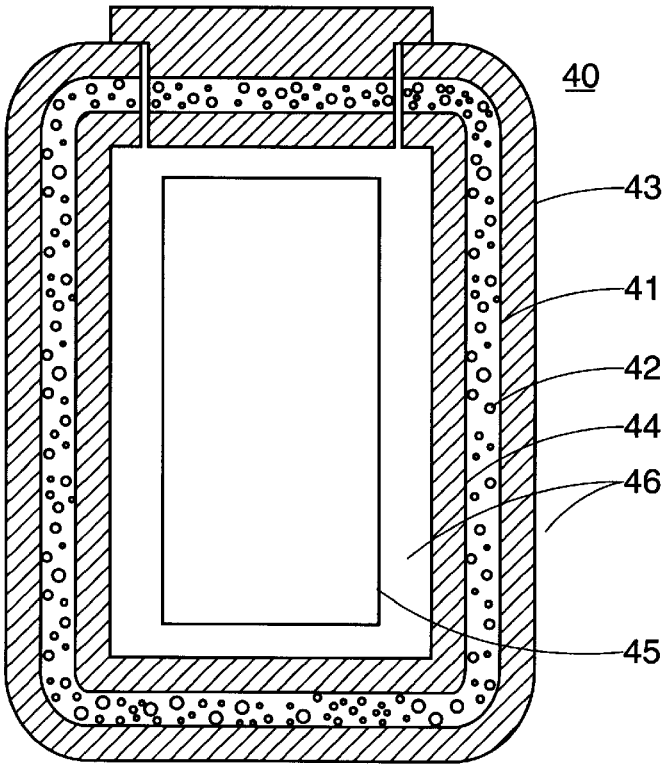
FIG. 4 is a side cross sectional view of a radiation shielding container comprising a concrete container having a metal liner and a metal shell using the concrete composition of this invention, and a ventilation system for cooling the container.
Figure 5:
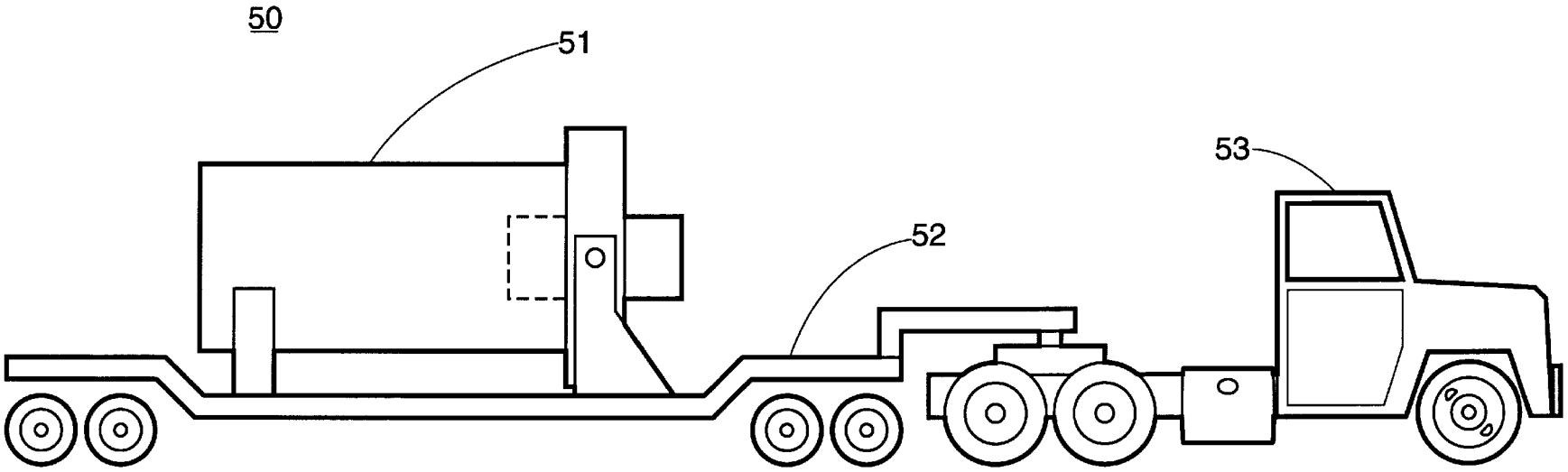
FIG. 5 shows the positioning of the concrete container, which has radioactive material housed therein, on a trailer with a tractor unit to be transported to a storage unit.

As shown in FIG. 4 a radiation shielding container 40 of this invention comprises concrete layer 41 containing stable uranium aggregate 42 having metal shell 43 and metal liner 44, said shell and liner preferably made of steel, containing a metal container of radioactive material 45 with void spaces 46 between the radioactive material container 45 and the metal liner 4 and outside the metal shell 43 and wherein these void spaces 46 are connected to a ventilation system, not shown, to maintain and control the temperature of the container 40 as well as the composition of the environment surrounding container 40.

EXAMPLES

In nuclear fuel applications, $UF_6$ is hydrolyzed with water and precipitated as ammonium diurante or ammonium uranyl carbonate, by addition of ammonia or ammonium carbonate respectively. The precipitate is dried and then calcined and reduced at 800° C. in hydrogen to produce $UO_2$ powder. This process could be used with depleted $UF_6$ to produce depleted $UO_2$.

Once uranium oxide is produced from the depleted $UF_6$, it is then consolidated into coarse aggregate. For nuclear fuels, $UO_2$ pellets are produced by cold pressing to about 60% density followed by sintering under hydrogen at 1750° C. or hot pressed at 7,000 kg/cm$^2$ and temperatures of up to 2300° C. This produces $UO_2$ pellets with a density of 95% theoretical. (Note that the uranium-oxygen system is complex, contains a large number of oxides, and many of these oxides exhibit deviations from stoichiometry. Deviations from stoichiometry can have significant effects on densification behavior. Thus, the description of the oxides in these examples as stoichiometric $UO_2$ and $U_3O_8$ is somewhat simplified.)

While cold pressing with sintering or hot pressing could be used to form the coarse aggregate for this concept, simpler more cost effective processes are preferred. For example, uranium oxide powder is mixed with a small amount of polyvinyl alcohol and allowed to form into roughly spherical clumps under agitation by the "flying disk" process and then heated and sintered to remove the alcohol and fuse the powders. While the aggregates produced in this manner would likely have lower densities (80–90% of theoretical), the process is much simpler. Alternately, small amounts of liquid phase sintering agents (chemical compounds which are liquid at the sintering temperature) are used to lower sintering temperatures and increase aggregate densities. Such processes can readily produce coarse aggregates with sizes comparable to those of coarse aggregates in conventional concretes.

Concrete incorporating depleted uranium oxide aggregate is produced by conventional-means. Mix proportions for conventional heavy aggregate concretes are similar to those used for construction concretes. Such mix proportions are also suitable for use with the depleted uranium oxide aggregates. Mix proportions are 1 part cement, 2 parts sand, and 4 parts coarse aggregate by weight, with about 5.5 to 6 gallons of water per 94-lb bag of cement. Ordinary Portland cement Portland Type I-II cement) is used. The water/cement ratio (which could affect neutron absorption) is selected to maximize the concrete strength. Uranium oxide aggregates are coated with a water and air impermeable coating to provide desired stability at elevated temperatures. Heavy mineral fines (e.g., barite or magnetite sands) are used as a replacement for sand if further increases in concrete density are desired. Neutron absorbing additives, such as boron compounds or reinforcing materials such as metal fibers (for strengthening the concrete) are also added as needed.

A $UO_2$ aggregate concrete, using typical standard mix proportions, has a density of between about 6.8 and about 8.0 g/m$^3$ (420 to 500 lb/ft$^3$), depending upon the density of the $U0_2$ aggregate and whether silica sand or barite sand is used.

Depleted uranium oxide concrete has a much higher density than conventional heavy aggregate concretes or construction concretes (Table (1). Since the shielding advantage for gamma radiation is approximately proportional to the density of the concrete, a unit thickness of depleted $UO_2$ concrete provides an average of 1.8 times the shielding of conventional heavy aggregate concrete (contains barite, magnetite or limonite as a replacement for conventional gravel aggregate) and 3.2 times that for construction concrete.

The improved shielding performance of $U0_2$ aggregate concrete provides 2 significant container weight savings. A vendor of spent fuel storage 3 casks uses a 29 inch thickness of conventional concrete (150 lb/ft$^3$) as a 4 radiation shield. Depleted $UO_2$ concrete with a density of 500 lb/ft$^3$ requires slightly less than 9 inches to provide the same amount of gamma radiation shielding. A container having length of 16 feet, excluding capped ends, inside diameter of 70.5 inches, and required wall thickness of 29 inches for conventional concrete and 9 inches for depleted $UO_2$ concrete, the depleted uranium concrete container (including capped ends) weighs 27% less than the conventional concrete container.

TABLE 1

Density and equivalent shielding for different concrete types.

| Concrete Type | Aggregate Density, g/cm$^3$ | Concrete Density, g/cm$^3$ | Equivalent Shielding Thickness Ratio[a] |
|---|---|---|---|
| Construction Concrete | 2.7 | 2.2 to 2.4 | 3.2 |
| Conventional Heavy Aggregate Concrete | 3.6 to 7.8 | 3.4 to 4.8 | 1.8 |
| $UO_2$ Aggregate Concrete | 9.9 to 11 | 6.8 to 8.0 | 1 |

[a]Equivalent shielding thickness ratio for gamma radiation assuming average concrete type density.

In addition to potential weight advantages, as illustrated in the 31 preceding paragraph, significant space savings are also obtained. In the above example, the 70.5 inch inside diameter concrete cask contains an inner metal container holding 24 PWR spent fuel elements has an outside diameter of 129 inches. A depleted $U0_2$ concrete cask, having the same 70.5 inch inside diameter has an outside diameter of about 90 inches. Thus, increased shielding capability of the uranium aggregate containing concrete of this invention compared to that of conventional concrete can provide increased storage capacity and/or save space in a shielding container.

Also, the potential smaller size of the $UO_2$concrete cask makes it easier to manufacture (e.g., lower form costs, etc.) and transport, as compared to a cask made from conventional concrete.

Another cost benefit of this invention utilizing depleted uranium aggregate is the costs that are avoided by not having to continue to store depleted $UF_6$ gas in pressurized containers. There are also costs associated with the potential for release to the environment and other possible safety issues that are avoided. In addition, the stored $UF_6$ will eventually have to be processed for disposal or some other use.

ADDITIONAL EXAMPLES

Dense depleted uranium oxide ($UO_2$ and $U_3O_8$) pellets are used to replace conventional gravel in portland cement based concrete. The strength value for this uranium oxide pellet based concrete is in the range of typical construction grade gravel based concrete for an equivalent 7 day curing time. The uranium oxide pellet based concrete exhibits about 20% lower compression strength values than equivalent gravel based concrete.

When the uranium oxide pellet based concrete is exposed to temperatures of between 90° C. and 150° C. for 28 days the compressive strength shows a slight decline. The mean tensile strength is increased under these conditions.

Comparable gravel based concrete shows a 1291 psi decrease in mean compressive strength when exposed to a temperature of 250° C. of moist air for 14 days. A volume equivalent sample of depleted uranium oxide pellet concrete similarly formulated, cracks or completely disintegrates under this same 250° C. temperature for 14 days.

Testing of the failed uranium oxide pellet based concrete shows strong evidence that oxygen diffuses through the concrete and reacts with the uranium oxide as evidenced by the increase of the oxygen to uranium ratio of the surface of the uranium oxide pellets from the deteriorated concrete. The concurrent decrease in crystal density in the affected region of the pellet causes a volume increase that leads to outward expansion of the uranium oxide pellet. This outward expansion results in a build-up of stresses within the cement/sand matrix of the concrete. Eventually these stresses lead to fracture of the portland cement that is bonding the sand and uranium oxide pellets together.

Detailed microscopic analysis of the surface of both the $UO_2$ and $U_3O_8$ large pellets contained in the deteriorated portland cement shows severe cracks.

Reaction of the uranium oxide with water vapor and chemicals of the cement are believed to be possible contributing factors to the failure of the concrete.

Uranium oxide pellets are then prepared by sintering with artificial basalt using the method described above for the examples. During sintering liquid basalt surrounds the uranium oxide grains which then hardens to form a vapor impermeable coating around the uranium oxide grains which provide a protective barrier to oxidizing gases (oxygen and/or water vapor) from the atmosphere and chemicals from portland cement.

These vapor and chemically impermeable coated uranium oxide pellets thus formed are then used to prepare concrete samples using similar concrete formulations as used for the temperature/humidity tests described above. When exposed to moist air at the temperature of 250° C. for 28 days the samples of concrete containing coated uranium oxide pellets show no degradation of the concrete, no evidence of cracking, and no decrease in compressive strength.

Other tests using uranium oxide coated with vapor and chemical impermeable coatings of metal, glass, and polymer when formed into pellets and then used to prepare concrete give similar improved results in similar temperature/humidity tests. Also using chemically more stable uranium silicide in place of the coated uranium oxide to form the pellets used to make the concrete gives similar improved results under the same temperature/humidity test conditions.

Due to the long life of the radioactive materials stored in the storage casks of this invention it is very important that the concrete be able to resist degradation due to high temperatures and humidity over many decades. The concrete casks prepared using the improved stability uranium compound pellets of the invention provide this desired long life resistance to high temperature and humidity. Normally the storage temperatures will not exceed 150° C.; however, due to the dangers associated with the stored radioactive waste if it is released, this invention provides the desired extra protection in case of emergency high temperature/humidity conditions.

We claim:

1. A radiation shielding concrete product comprising a stable depleted uranium aggregate and a neutron absorbing component, said uranium aggregate and neutron absorbing component being present in said concrete product in sufficient amounts to provide a concrete having a density between about 4 and about 15 grams per $cm^3$ a nd which will, at a predetermined thickness, attenuate gamma rays and absorb neutrons from a radioactive material of projected gamma ray and neutron emissions over a determined time period.

2. A product as in claim 1 wherein said depleted uranium aggregate is coated with a vapor impermeable coating such that said uranium material is sufficiently stable as to prevent degradation of said concrete at a temperature of 250° C. for a period of at least one month when in an environment which would be saturated with water vapor at room temperature.

3. A product as in claim 2 wherein said depleted uranium aggregate is a member selected from the group consisting of a uranium oxide and a uranium silicide.

4. A product as in claim 2 wherein said depleted uranium aggregate is coated with a water and air impermeable protective coating.

5. A product as in claim 2 wherein said neutron absorbing component is a member selected from the group consisting of hydrogen and compounds of boron, hafnium and gadolinium.

6. A product as in claim 2 wherein the amount of said uranium aggregate contained in said concrete, at said predetermined thickness, is based on the projected gamma ray emission from said radioactive material.

7. A product as in claim 2 wherein the amount of said neutron absorbing component contained in said concrete, at said predetermined thickness, is based on the projected neutron emission from said radioactive material.

8. A product as in claim 2 wherein the amount of said uranium aggregate, the amount of said neutron absorbing component, and the ratio of said uranium aggregate to said neutron absorbing component contained is said concrete, at said predetermined thickness, is based on the projected gamma ray and neutron emissions from said radioactive material.

9. A product as in claim 8 wherein said concrete product has a compressive strength between about 500 and about 12,000 psi and a tensile strength between about 50 and about 1200 psi.

10. A product as in claim 1 wherein said uranium aggregate is inherently more resistant to chemical reaction then uranium oxide ($UO_2$) so as to prevent degradation of said concrete at a temperature of 25° C. for a period of at least one month when in an environment which is saturated with water vapor at room temperature.

11. A product as in claim 10 wherein said uranium aggregate is uranium silicide.

12. A stabilized depleted uranium material for use in a radiation shielding material comprising:

at lease one particle of a depleted uranium compound, said particle having a surface; and a vapor impermeable layer circumferentially disposed on the surface of said particle wherein said layer does not substantially degrade at a temperature of at least one month in an environment that would be saturated with water vapor at room temperature.

13. The stabilized depleted uranium material of claim 12 wherein the depleted uranium compound is a member selected from the group consisting of uranium suicides, uranium borides, uranium nitrides, uranium phosphides, uranium sulfides, uranium arsenides, uranium selenides, uranium tellurides, uranium carbides, uranium bismuthides, uranium antimonides, and mixtures thereof.

14. The stabilized depleted uranium material of claim 13 wherein said layer is formed by the reaction of said depleted uranium compound with a stabilizing agent.

15. The stabilized depleted uranium material of claim 14 wherein said depleted uranium compound comprises uranium silicide and said stabilized depleted uranium material is mixed in a radiation shielding material comprising concrete.

16. The stabilized depleted uranium material of claim 14 wherein said stabilizing agent is an oxidizing agent that reacts with said depleted uranium compound to result in a product that is substantially water and air impermeable.

17. The stabilized depleted uranium material of claim 12 wherein said layer is formed by coating said particle with a coating material selected from the group consisting of cement, ceramic material, bituminous material, metal, composite, polymer cement, polymer, glass, and mixtures thereof.

18. The stabilized depleted uranium material of claim 17 wherein said coating material comprises a neutron absorbing material selected from the group consisting of compounds of beryllium, boron, cadmium, hafnium, iridium, mercury, europium, gadolinium, samarium, dysprosium, erbium, lutetium, and mixtures thereof.

19. The stabilized depleted uranium material of claim 12 further comprising:

binding means for binding a plurality of said particles together to form an aggregate thereof.

20. The stabilized depleted uranium material of claim 19 wherein said binding means is a member selected from the group consisting of glasses, polymers, cements, ceramics, bituminous materials, metals, composites, polymer cements, and mixtures thereof.

21. The stabilized depleted uranium material of claim 20 wherein said binding means further comprises a neutron absorbing material is a member selected from the group consisting of compounds of beryllium, boron, cadmium, hafnium, iridium, mercury, europium, gadolinium, samarium, dysprosium, erbium and lutetium and mixtures thereof.

22. The stabilized depleted uranium material of claim 12 wherein at least two of said particles are fused together to form an aggregate thereof.

23. The stabilized depleted uranium material of claim 22 wherein said aggregate further comprises a neutron absorbing material is a member selected from the group consisting of compounds of beryllium, boron, cadmium, hafnium, iridium, mercury, europium, gadolinium, samarium, dysprosium, erbium and lutetium and mixtures thereof.

24. A method of making a stabilized depleted uranium material for use in a radiation shielding material comprising the steps of:

(a) providing a particle of a depleted uranium compound, said particle having a surface; and (b) forming a vapor impermeable layer circumferentially disposed on the surface of said particle wherein said layer does not substantially degrade at a temperature of between about 90° C. and 250° C. for a period of at least one month in an environment that would be saturated with water vapor at room temperature.

25. The method of claim 24 wherein the depleted uranium compound is a member selected from the group consisting of uranium silicides, uranium borides, uranium nitrides, uranium phosphides, uranium sulfides, uranium arsenides, uranium selenides, uranium tellurides, uranium carbides, uranium bismuthides, uranium antimonides, and mixtures thereof.

26. The method of claim 25 wherein said depleted uranium compound comprises uranium silicide and said stabilized depleted uranium material is mixed in a radiation shielding material comprising concrete.

27. The method of claim 24 wherein said layer is formed by reaction of said depleted uranium compound with a stabilizing agent.

28. The method of claim 27 wherein said stabilizing agent is an oxidizing agent that reacts with said depleted uranium compound to result in a product that is substantially water and air impermeable.

29. The method of claim 24 wherein said layer is formed by coating said particle with a coating material selected from the group consisting of cement, ceramic material, bituminous material, metal, composite, polymer cement, polymer, glass, and mixtures thereof.

30. The method of claim 29 wherein said coating material comprises a neutron absorbing material selected from the group consisting of compounds of beryllium, boron, cadmium, hafnium, iridium, mercury, europium, gadolinium, samarium, dysprosium, erbium, lutetium, and mixtures thereof.

* * * * *